US009242836B2

(12) United States Patent
Cao et al.

(10) Patent No.: US 9,242,836 B2
(45) Date of Patent: Jan. 26, 2016

(54) APPARATUS AND METHOD FOR AUTOMATICALLY ADJUSTING THE TENSION OF A FLEXIBLE GUIDE RAIL

(75) Inventors: Guohua Cao, Jiangsu (CN); Zhencai Zhu, Jiangsu (CN); Renyuan Wu, Jiangsu (CN); Jiancong Qin, Jiangsu (CN); Hongqiao Kang, Jiangsu (CN); Weihong Peng, Jiangsu (CN); Guoan Chen, Jiangsu (CN); Chongqiu Wang, Jiangsu (CN); Xingguo Shao, Jiangsu (CN); Yilei Li, Jiangsu (CN); Gongbo Zhou, Jiangsu (CN)

(73) Assignees: CHINA UNIVERSITY OF MINING AND TECHNOLOGY (CN); DONGNAN ELEVATOR CO., LTD. (CN)

( * ) Notice: Subject to any disclaimer, the term of this patent is extended or adjusted under 35 U.S.C. 154(b) by 264 days.

(21) Appl. No.: 13/637,949

(22) PCT Filed: Aug. 25, 2011

(86) PCT No.: PCT/CN2011/078880

§ 371 (c)(1),
(2), (4) Date: Dec. 5, 2012

(87) PCT Pub. No.: WO2012/071912

PCT Pub. Date: Jun. 7, 2012

(65) Prior Publication Data

US 2013/0233654 A1 Sep. 12, 2013

(30) Foreign Application Priority Data

Dec. 3, 2010 (CN) ..... 2010 1 0572049

(51) Int. Cl.
*B66B 7/02* (2006.01)
*B66B 19/00* (2006.01)

(Continued)

(52) U.S. Cl.
CPC ..... *B66B 7/025* (2013.01); *B66B 19/002* (2013.01); *B21F 9/002* (2013.01); *E21D 7/02* (2013.01)

(58) Field of Classification Search
CPC ..... B66B 7/025; B66B 7/1246; B66B 19/00; B66B 19/002; B21F 9/002; E21D 7/02
USPC ..... 187/407, 412; 73/862.584, 862.581; 14/21, 22; 254/228
See application file for complete search history.

(56) References Cited

U.S. PATENT DOCUMENTS 3,692,277 A * 9/1972 Schwartz et al. ..... 254/29 A
4,615,509 A * 10/1986 Biass ..... 254/264

(Continued)

FOREIGN PATENT DOCUMENTS

CN 1316365 10/2001 ..... B63B 27/16
CN 2789398 6/2006 ..... E06C 1/52

(Continued)

OTHER PUBLICATIONS

Wikibooks.org, Introductory PLC Programming, Apr. 19, 2015, pp. 1-2 of 7.*

(Continued)

*Primary Examiner* — William A Rivera
*Assistant Examiner* — Stefan Kruer
(74) *Attorney, Agent, or Firm* — Hayes Soloway P.C.

(57) ABSTRACT

Disclosed are an apparatus and a method of automatically adjusting a tension of a steel rope that comprises a guide system along which a mining elevator car moves vertically. The apparatus and the method allow the flexible guide rail to be structurally simple, convenient to process, reliable in performance, and easy to install and to maintain. The apparatus and the method allow restriction of vertical orientation and horizontal deflection, and are capable of real-time detection and automatic adjustment of the tension in the flexible guide rail of the elevator.

3 Claims, 4 Drawing Sheets

(51) Int. Cl.

| | |
|---|---|
| ***B21F 9/00*** | (2006.01) |
| ***E21D 7/02*** | (2006.01) |

(56) References Cited

U.S. PATENT DOCUMENTS

| | | | | |
|---|---|---|---|---|
| 5,809,710 | A * | 9/1998 | Jungwirth et al. | 52/223.1 |
| 6,283,451 | B1 * | 9/2001 | Stankus et al. | 254/228 |
| 6,352,226 | B1 | 3/2002 | Gordon | 248/125.2 |
| 7,143,871 | B2 | 12/2006 | Wesson et al. | 187/334 |
| 7,313,975 | B1 * | 1/2008 | Scorteanu | 73/862.454 |
| 2011/0168960 | A1 * | 7/2011 | Steidinger et al. | 254/228 |

FOREIGN PATENT DOCUMENTS

| | | | | |
|---|---|---|---|---|
| CN | 102085993 | | 6/2011 | B66B 7/02 |
| CN | 201873409 | | 6/2011 | B66B 7/00 |
| GB | 846096 | A * | 8/1960 | E21D 7/02 |
| GB | 897025 | A * | 5/1962 | B66B 7/06 |
| SU | 593998 | | 2/1978 | B66B 5/08 |
| WO | 2012/071912 | | 6/2012 | B66B 7/02 |

OTHER PUBLICATIONS

International Search Report issued in PCT/CN2011/078880, dated Dec. 1, 2011, with English translation. (6 pgs.).

* cited by examiner

APPARATUS AND METHOD FOR AUTOMATICALLY ADJUSTING THE TENSION OF A FLEXIBLE GUIDE RAIL

FIELD OF THE INVENTION

The present invention relates to an apparatus and method for automatically adjusting the tension of a flexible guide rail of a mining elevator, and is particularly applicable to an elevator guide rail system that can not be satisfied by a rigid guide rail in an underground mine.

BACKGROUND OF THE INVENTION

At present, elevator guiding systems mainly adopt rigid guide rails. As the rigid guide rail has errors during design, manufacture and installation, and shaft wall of the mine bears huge pressure and is deformed, lateral inclination, bending deformation, joint dislocation and local projection of the guide rail happen frequently. Consequently, the elevator car shakes violently during elevating. In serious cases, the elevator sliding guide shoes or the rolling guide wheel relying on the low-clearance guide rail are stuck and subsequently the elevator car is stuck in the shaft. It is a great hidden danger to the safe operation of the mining elevator and threatens the life and safety of the passengers in the elevator car.

In the current mine shafts, flexible guide rails of steel rope guides have been used, which are mostly a steel rope guide system based on tightening by heavy hammer in bottom hole, a steel rope guide system tightening by a hydraulic screw and a hydraulic tensioner based on a high-speed clip. Among them, the advantage of the steel rope guide system based on tightening by heavy hammer in bottom hole is a stable tightening force, but the heavier the goods in the elevating container is, the greater the mass of the heavy hammer for tightening will be and the larger the occupied space will be needed. Therefore, a deeper shaft sump needs to be dug. If coal briquettes or other sundries fall into the shaft sump and raise the level of sump bottom, i.e., the tightening force of the heavy hammer is decreased, resulting in serious lateral deflection of the elevator car. What is more, low work efficiency, high labor intensity and the accurate weight of the heavy hammer is difficult to be adjusted. The steel rope guide system tightening by a hydraulic screw overcomes many shortcomings of the tightening by heavy hammer, but the processing of the wedge device is difficult and it is not easy to have the wedge enter the bottom of the fixing device. As a result, the slipping between the steel rope and the wedge happens, resulting in fall of the steel rope of the guide from the top. The hydraulic tensioner based on a high-speed clip overcomes the drawbacks of the heavy hammer type and the screw type hydraulic tightening systems, but in case that the tightening force of the steel rope decreases due to permanent continuous tension, the steel rope is unable to realize automatic tensioning. To tension it, the steel rope clamp plate must be loosened manually. If the stroke of the cylinder is not long enough, the required tension cannot be achieved unless the steel rope is tensioned again, resulting in low efficiency of the lifting system.

According to the above analysis, it can be known that the current rigid guide rails for mining elevators cannot meet the requirement of normal lifting and there is not a steel rope guide system for mining elevator; the tightening heavy hammer in a steel rope guide system based on tightening by heavy hammer in bottom hole has large mass, occupies a large space, and the weight can not be adjusted easily; processing of the wedges of the steel rope guide system based on tightening by a hydraulic screw is difficult, and it is easy to cause the slipping between the steel rope and the wedge; the hydraulic tensioner based on a high-speed clip cannot be automatically adjusted and is inefficient.

DISCLOSURE OF THE INVENTION

Technical Problem

The object of the present invention is to provide a device and method for automatically adjusting the tension of a flexible guide rail of a mining elevator, which is characterized by a simple structure, easy processing, reliable performance, easy installation and maintenance, longitudinal guiding and transversal deflection constraint, and can monitor the tension of the guide rail in real time and perform automatically according to the monitored tension.

Technical Solution

A device for automatically adjusting the tension of a flexible guide rail of a mining elevator according to the present invention comprises an wellhead automatic tightening device and a bottom hole fixing device connected to the two ends of a steel rope respectively. The wellhead automatic tightening device is connected to a hydraulic system and a tension detection system. The wellhead automatic tightening device comprises a lower fixer seat disposed on an upper carrier bar. On the lower fixer seat, tightening oil cylinder blocks on the left and right sides of the steel rope, and a hinge pin fixing seat and a support frame in front of and behind the steel rope are disposed. Anti-fall seats are disposed in front of and behind the tightening oil cylinder blocks. The plungers inside the tightening oil cylinder blocks are connected to the hinge pin seats fixed on the bottom of the hinge pin fixing seat via hinge pins. An anti-fall rope clamp preventing the fall of the steel rope is disposed under the hinge pin fixing seat. A tightening fixing rope clamp is disposed over the hinge pin fixing seat. An upper fixer seat for fixing the left and right guideposts are disposed on the support frame. A rope adjusting guiding clamp is disposed on the upper fixer seat. Guide slots movable vertically along the guide posts are disposed on the two sides of the hinge pin fixing seat. The bottom hole fixing device comprises a fixing plate on the lower carrier bar. On the fixing plate, there is a fixing rope clamp fixed on the lower end of the steel rope.

The tension detection system comprises an oil pressure sensor disposed on the pipeline of the hydraulic system, a signal collector connected to the oil pressure sensor, and an industrial personal computer for real-time detection connected to the signal collector.

A method for automatically adjusting the tension of a flexible guide rail of a mining elevator according to the present invention monitors the tension of the steel rope through an oil pressure sensor in real time, and transfers the collected data to an industrial personal computer of a tension detection system through a signal collector. In the industrial personal computer, the data are analyzed and processed.

When the tension of the steel rope is lower than the lower limit value set by the industrial personal computer, the industrial personal computer drives the hydraulic system to pressurize the pipeline at the bottom of the tightening oil cylinder blocks to push the plungers. The plungers push upwards the tightening fixing rope clamp fixed on the hinge pin fixing seat to tighten the steel rope.

When the primary lift of the plungers is unable to make the tension of the steel rope reach the upper limit value set by the industrial personal computer, the cylinders apply pressure to the other side, the plungers pull the tightening fixing rope clamp fixed on the hinge pin fixing seat back from the top, and the wedge of the tightening fixing rope clamp is disengaged from the steel rope, while due to the self-locking feature of the wedge, the steel rope of the anti-fall rope clamp and the rope adjusting guiding clamp is clamped by the wedge and the tension of the steel rope is maintained.

Subsequently, the pipeline at the bottom of the tightening oil cylinder blocks is further pressurized to push the plungers upwards. This process is repeated one time or a few times until the tension of the steel rope reaches the upper limit value set by the industrial personal computer.

Beneficial Effects

The present invention can perform longitudinal guiding and transversal deflection restriction on the lift car during lifting. The guide rail can overcome the lateral deformation of the shaft and ensure the lift car of the mining elevator moves stably on the flexible guide rail. Meanwhile, it can monitor the tension of the guide rail in real time, perform automatic adjustment according to the value of tension and realize the functions of automatic monitoring and automatic adjustment. It is also applicable to the steel rope cage guide guiding systems of mine cages and skips. It has the following advantages:

(1) The flexible guide rail can maintain the required tension, perform longitudinal guiding and transversal deflection restriction and realize reliable operation of the lift car.

(2) Compared with a rigid guide rail, the flexible guide rail features simple installation and maintenance and low cost. The flexible guide rail is particularly applicable to a mine shaft with large lateral deformation, which can not be solved by a rigid guide rail, and solves the problems of large noise, violent lateral vibration and even sticking during the lift car of a conventional mining elevator moves upwards along a rigid guide rail.

(3) The automatic tension adjustment system can monitor the tension of the steel rope in real time, automatically adjust the tension, realize automatic monitoring and automatic correction of the tension, and improve the safety, reliability and comfort of riding the lift car.

In the figures: wellhead automatic tightening device—1, bottom hole fixing device—2, steel rope—3, tension detection system—4, hydraulic system—5; upper carrier bar—1-1, tightening oil cylinder block—1-2, plunger—1-3, hinge pin—1-4, hinge pin seat—1-5, support frame—1-6, guide post—1-7, rope adjusting guiding clamp—1-8, upper fixer seat—1-9, tightening fixing rope clamp—1-10, hinge pin fixing seat—1-11, anti-fail rope clamp—1-12, anti-fall seat—1-13, lower fixer seat—1-14, wedge—1-15, pin roller—1-16, rack—1-17, connecting bolt—1-18, front clamp plate—1-19, rear clamp plate—1-20; lower carrier bar—2-1, fixing bolt—2-2, fixing plate—2-3, rope clamp—2-4, fixing rope clamp—2-5; oil pressure sensor—4-1, signal collector—4-2, industrial personal computer—4-3.

DETAILED DESCRIPTION OF THE EMBODIMENTS

Figure 1:
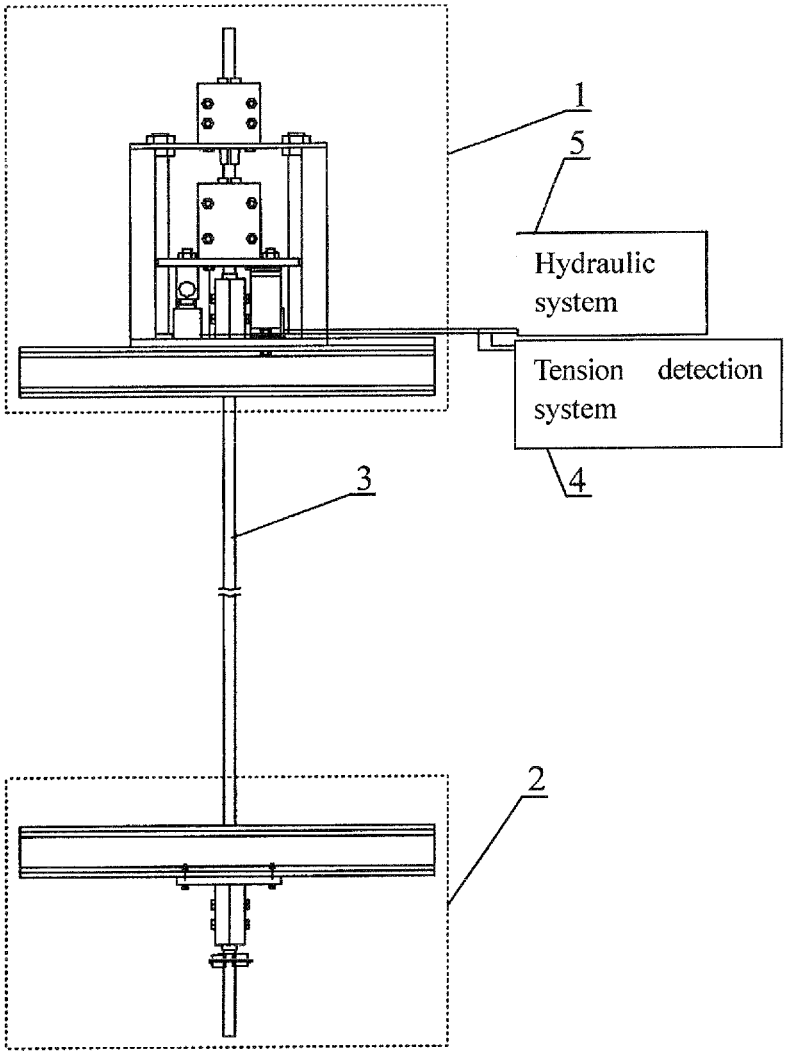
FIG. 1 is a structural view of the device of the present invention for automatically adjusting the tension of a flexible guide rail of a mining elevator.

An embodiment of the present invention is described below by referring to the accompanying drawings:

As shown in FIG. 1, a device for automatically adjusting the tension of a flexible guide rail of a mining elevator mainly comprises an wellhead automatic tightening device 1 disposed on an upper carrier bar 1-1, a bottom hole fixing device 2, a steel rope 3, a tension detection system 4 and a hydraulic system 5. The wellhead automatic tightening device 1 and the bottom hole fixing device 2 are connected with a steel rope 3 between them. The hydraulic system 5 and the tension detection system 4 are connected to the wellhead automatic tightening device 1.

Figure 2:
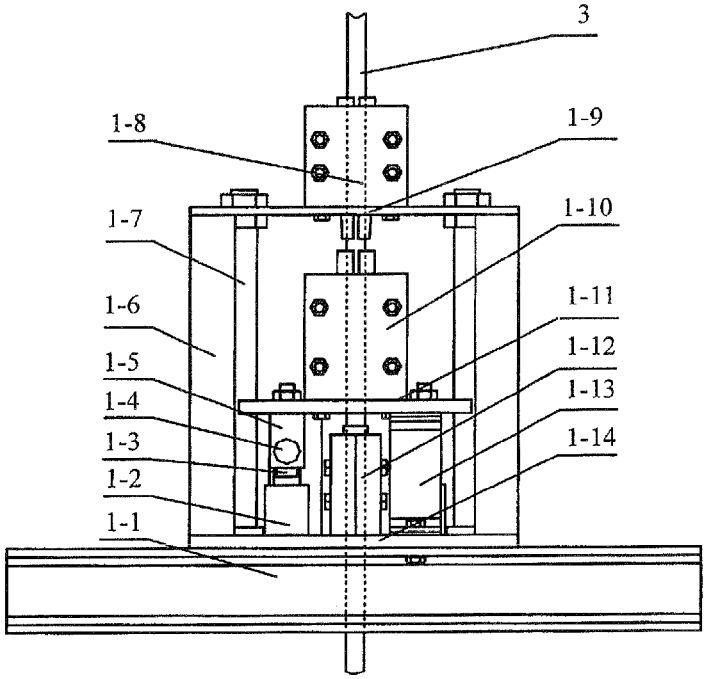
FIG. 2 is a front view of the structure of a wellhead automatic tightening device of the present invention.
Figure 3:
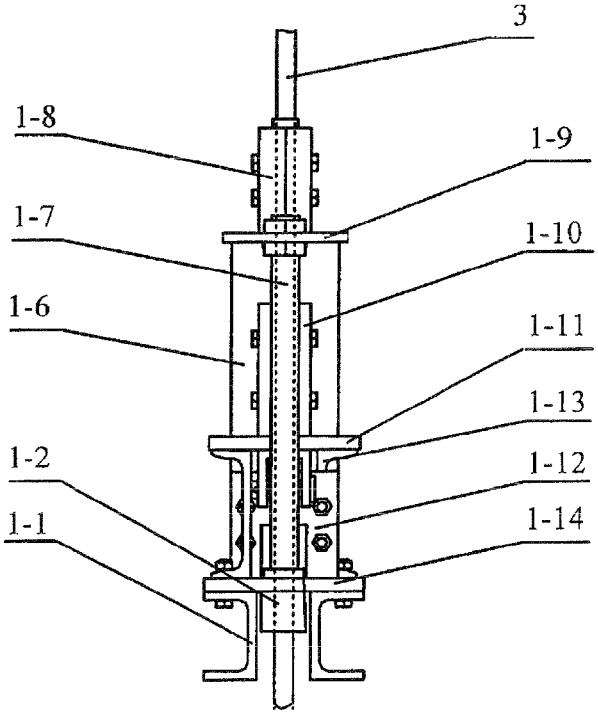
FIG. 3 is a side view of the structure of a wellhead automatic tightening device of the present invention.

In the wellhead automatic tightening device 1 shown in FIG. 2 and FIG. 3, a lower fixer seat 1-14 is disposed on an upper carrier bar 1-1. The lower fixer seat 1-14 is successively provided with an anti-fall rope clamp 1-12 for fixing a steel rope 3, a tightening fixing rope clamp 1-10 and a rope adjusting guiding clamp 1-8. Tightening oil cylinder blocks 1-2 are disposed on the left and right sides of the anti-fall rope clamp 1-12. Anti-fall seats 1-13 are disposed in front of and behind of the tightening oil cylinder blocks 1-2. A hinge pin fixing seat 1-11 is disposed on the anti-fall rope clamp 1-12. The tightening fixing rope clamp 1-10 is disposed on the hinge pin fixing seat 1-11. The plungers 1-3 inside the tightening oil cylinder blocks 1-2 are connected to the hinge pin seats 1-5 fixed on the bottom of the hinge pin fixing seat 1-11 via the hinge pins 1-4. A support frame 1-6 is disposed outside the hinge pin fixing seat 1-11. An upper fixer seat 1-9 for fixing the left and right guide posts 1-7 are disposed on the support frame 1-6. A rope adjusting guiding clamp 1-8 is disposed on the upper fixer seat 1-9. Guide slots movable vertically along the guide posts 1-7 are disposed on the end faces of the two sides of the hinge pin fixing seat 1-11. The load received by the rope adjusting guiding clamp 1-8 of the upper fixer seat 1-9 is borne by the support frame 1-6 on the two sides. The support frame 1-6 is a channel beam, which is connected and fixed to the upper fixer seat 1-9 and the lower fixer seat 1-8.

Figure 4:
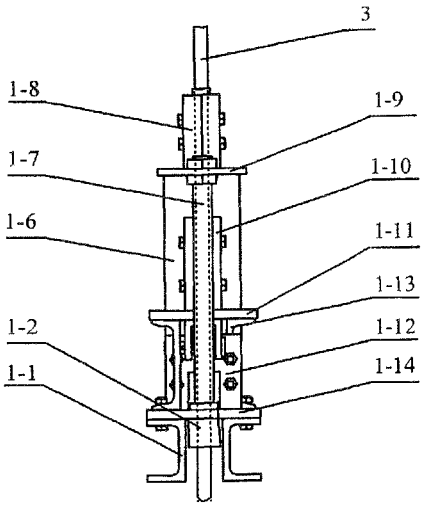
FIG. 4 is a front view of the structure of a rope clamp of the present invention.
Figure 5:
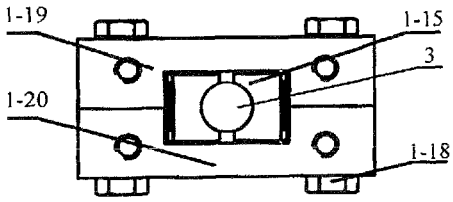
FIG. 5 is a top view of the structure of a rope clamp of the present invention.

As shown in FIG. 4 and FIG. 5, all rope clamps fixed on the steel rope 3 have same structures, and the only difference is their sizes. The structure of each rope clamp comprises a front clamp plate 1-19 and a rear clamp plate 1-20 with a wedge slot in the middle. The front and rear clamp plates are connected and fixed with a connecting bolt 1-18. Inside each wedge slot, there are two symmetric wedges 1-15 movable vertically. On the opposite planes of the two wedges 1-15, arc rope slots are opened. Between the other plane of each wedge and the wedge slot, a rack 1-17 with a pin roller 1-16 is disposed.

Figure 6:
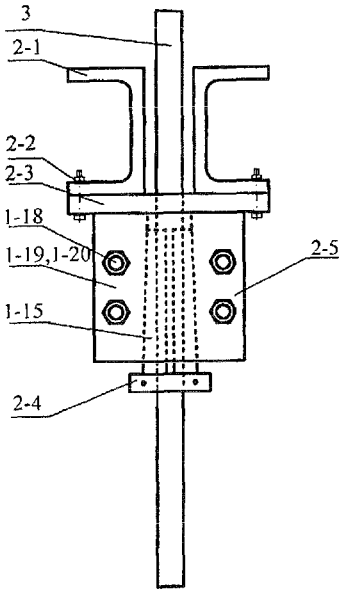
FIG. 6 is a front view of the structure of a bottom hole fixing device of the present invention.
Figure 7:
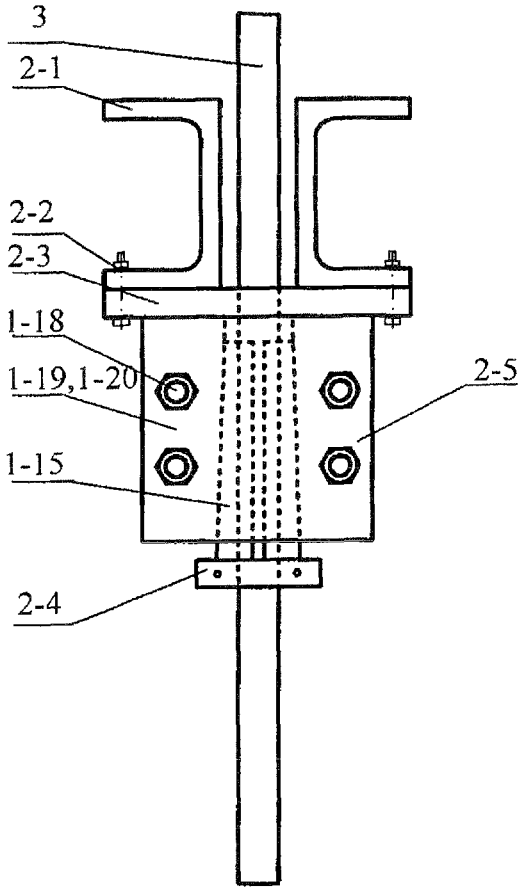
FIG. 7 is a side view of the structure of a bottom hole fixing device of the present invention.

In the bottom hole fixing device 2 as shown in FIG. 6 and FIG. 7, the fixing rope clamp 2-5 at the lower end is reversely disposed on the steel rope 3, installed at the bottom of the lower carrier bar 2-1 via the fixing plate 2-3 and fixed by the fixing bolt 2-2. The fixing rope clamp 2-5 is installed in a reverse and inverted manner relative to the rope adjusting guiding clamp 1-8, the tightening fixing rope clamp 1-10 and the anti-fall rope clamp 1-12. Likewise, the steel rope 3 also runs through the central rope slot of the wedge 1-15 of the fixing rope clamp 2-5, and is clamped via the rope clamp 2-4.

Figure 8:
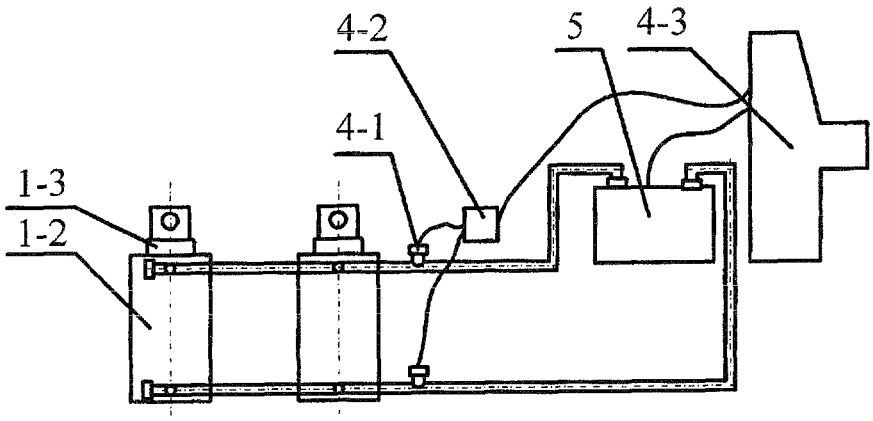
FIG. 8 is a structural drawing of a tension detection system of the present invention.

The tension detection system as shown in FIG. 8 comprises an oil pressure sensor 4-1 disposed on the pipeline of the hydraulic system 5, a signal collector 4-2 connected to the oil pressure sensor 4-1 and an industrial personal computer 4-3 for real-time detection connected to the signal collector 4-2.

A method for automatically adjusting the tension of a flexible guide rail of a mining elevator according to the present invention:

(1) At first, each wedge 1-15 of the rope adjusting guiding clamp 1-8, the tightening fixing rope clamp 1-10 and the anti-fall rope clamp 1-12 are lifted, and the steel rope 3 is put through the central rope slot of each wedge 1-15 of the rope adjusting guiding clamp 1-8, the tightening fixing rope clamp 1-10 and the anti-fall rope clamp 1-12 until the rope reaches the bottom hole; the wedge 1-15 of the rope adjusting guiding clamp 1-8 is put down to lock the steel rope 3, the steel rope 3 at the bottom hole is also put through the central rope slot of the inverted wedge 1-15 of the fixing rope clamp 2-1, clamped by the wedge 1-15 of the fixing rope clamp 2-1 and fixed by the rope clamp 2-4, and then connected to the lower carrier bar 2-3 at the bottom hole; afterwards, the wedges 1-15 of the tightening fixing rope clamp 2-1 and the anti-fall rope clamp 1-12 are put down and the plungers 1-3 inside the tightening oil cylinder blocks 1-2 are pushed upwards to drive the tightening fixing rope clamp 1-10 to move upwards, due to the self-locking feature of wedges 1-15, the steel rope 3 is clamped by the rope adjusting guiding clamp 1-8 and pulled up, the bottom hole fixing rope clamp 2-1 is also clamped due to the self-locking feature of wedges 1-15.

(2) The pressure inside the tightening oil cylinder blocks 1-2 is monitored via the oil pressure sensor 4-1 in real time, and the data collected by the signal collector are transferred to the industrial personal computer 4-3 to be analyzed and processed.

If the tension of the steel rope 3 is lower than the lower limit value set by the industrial personal computer 4-3, the industrial personal computer 4-3 will drive the hydraulic system 5 to pressurize the pipeline at the bottom of the tightening oil cylinder blocks 1-2 and push the plungers 1-3. The plungers 1-3 will push the tightening fixing rope clamp 1-10 fixed on the hinge pin fixing seat 1-11 upwards to tighten the steel rope 3.

If the primary lift of the plungers 1-3 is unable to make the tension of the steel rope 3 reach the upper limit value set by the industrial personal computer 4-3, the plungers 1-3 will pull the tightening fixing rope clamp 1-10 fixed on the hinge pin fixing seat 1-11 back from the top, and the wedge 1-15 of the tightening fixing rope clamp 1-10 will be disengaged from the steel rope 3, while due to the self-locking feature of the wedges 1-15 of the rope adjusting guiding clamp 1-8 and the anti-fall rope clamp 1-12, the steel rope 3 is clamped by the wedge 1-15 and the tension of the steel rope 3 is maintained.

Afterwards, the pipeline at the bottom of the tightening oil cylinder blocks 1-2 is further pressurized to push the plungers 1-3 upwards. The plungers 1-3 drive the tightening fixing rope clamp 1-10 to move upwards. The steel rope 3 inside the tightening fixing rope clamp 1-10 is clamped again and pulled up, thereby further increasing the tension of the steel rope 3. This process is repeated one time or a few times until the tension of the steel rope 3 reaches the upper limit value set by the industrial personal computer 4-3.

(3) Lastly, if the hydraulic system 5 breaks down, the tightening fixing rope clamp 1-10 is pulled back quickly, then the anti-fall seat 1-13 will block the tightening fixing rope clamp 1-10, thereby protecting the tightening oil cylinder blocks 1-2 and the plungers 1-3. At the moment, the steel rope 3 is clamped by the tightening fixing rope clamp 1-13, the rope adjusting guiding clamp 1-8 and the anti-fall rope clamp 1-12 to maintain tension, the oil pressure sensor 4-1 of the hydraulic system 5 performs monitoring, and the signals are transferred via the signal collector 4-2 to the industrial personal computer 4-3, for fault handling.

The invention claimed is:

1. A device that automatically adjusts a tension of a steel rope comprising a guide system along which a mining elevator car moves vertically, device comprising a wellhead automatic tightening device and a bottom hole fixing device connected respectively to two ends of a steel rope, the wellhead automatic tightening device being connected to a hydraulic system and a tension detection system; the wellhead automatic tightening device comprising a lower fixer seat installed on an upper carrier bar, tightening oil cylinder blocks disposed on left and right sides of an anti-fall rope clamp, anti-fall seats to either side of the tightening oil cylinder blocks, plungers inside tightening oil cylinder blocks connected to hinge pin seats fixed to a bottom of a hinge pin fixing seat via hinge pins, an anti-fall rope clamp preventing fall of the steel rope disposed under the hinge pin fixing seat, a tightening fixing rope clamp disposed on the hinge pin fixing seat, an upper fixer seat for fixing left and right guide posts disposed on the support frame, a rope adjusting guiding clamp disposed on the upper fixer seat, guide slots movable vertically along the guide posts disposed on two sides of the hinge pin fixing seat; and the bottom hole fixing device comprises a fixing plate on the lower carrier bar, wherein on the fixing plate a fixing rope clamp is fixed on the lower end of the steel rope.

2. The device according to claim 1, wherein, the tension detection system comprises an oil pressure sensor disposed on a pipeline of the hydraulic system, a signal collector connected to the oil pressure sensor, and an industrial personal computer connected to the signal collector, which computer detects the tension in real-time.

3. A method of automatically adjusting a tension of a steel rope that comprises a guide system along which a mining elevator car moves vertically, the method comprising monitoring the tension of the steel rope in real time using an oil pressure sensor, collecting tension data and transferring the collected data to an industrial personal computer of a tension detection system via a signal collector to perform analysis and processing;

wherein when the tension of the steel rope is lower than a lower limit value set by the industrial personal computer, the industrial personal computer sends a signal to drive a hydraulic system to pressurize a pipeline at a bottom of tightening oil cylinder blocks and push plungers, and the plungers push upwards a tightening fixing rope clamp fixed on a hinge pin fixing seat to tighten the steel rope;

wherein when a primary lift of the plungers is unable to make the tension of the steel rope reach an upper limit value set by the industrial personal computer, the plungers lift the tightening fixing rope clamp fixed on the hinge pin fixing seat, and a wedge of the tightening fixing rope clamp is disengaged from the steel rope, while due to a self-locking feature of wedges of a rope adjusting guiding clamp and an anti-fall rope clamp, the steel rope is clamped by a wedge of the rope adjusting guiding clamp and the tension of the steel rope is maintained; afterwards, the pipeline at the bottom of the tightening oil cylinder blocks is further pressurized to push the plungers upwards, and the monitoring, analysis and processing is repeated until the tension of the steel rope reaches an upper limit value set by the industrial personal computer.

* * * * *